US007773912B2

(12) United States Patent
Matsuyama

(10) Patent No.: US 7,773,912 B2
(45) Date of Patent: Aug. 10, 2010

(54) IMAGE FORMING APPARATUS AND LATENT-IMAGE-CARRIER POSITION ADJUSTING METHOD

(75) Inventor: Yasuo Matsuyama, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 312 days.

(21) Appl. No.: 11/952,585

(22) Filed: Dec. 7, 2007

(65) Prior Publication Data

US 2008/0138100 A1 Jun. 12, 2008

(30) Foreign Application Priority Data

Dec. 8, 2006 (JP) ..... 2006-331338

(51) Int. Cl.
*G03G 15/00* (2006.01)

(52) U.S. Cl. ..... 399/117

(58) Field of Classification Search ..... 399/110, 399/117, 167, 299, 301; 347/115, 116
See application file for complete search history.

(56) References Cited

U.S. PATENT DOCUMENTS

| | | | | |
|---|---|---|---|---|
| 5,565,965 | A * | 10/1996 | Costanza et al. | 399/167 |
| 6,300,968 | B1 * | 10/2001 | Kerxhalli et al. | 347/116 |
| 6,304,737 | B1 * | 10/2001 | Dotschkal | 399/117 |
| 6,334,039 | B1 * | 12/2001 | Yoshinaga et al. | 399/298 |
| 6,369,842 | B1 * | 4/2002 | Abramsohn | 347/116 |
| 6,909,516 | B1 * | 6/2005 | Hoover | 356/615 |
| 2002/0003975 | A1 * | 1/2002 | Fujimori | 399/298 |
| 2004/0022557 | A1 * | 2/2004 | Kudo | 399/167 |
| 2005/0207799 | A1 * | 9/2005 | Ebara | 399/299 |
| 2007/0242980 | A1 * | 10/2007 | Kikuchi et al. | 399/167 |

FOREIGN PATENT DOCUMENTS

| | | |
|---|---|---|
| JP | 64-84263 | 3/1989 |
| JP | 2000-347474 | 12/2000 |
| JP | 2001-265090 | 9/2001 |
| JP | 2003-205649 | 7/2003 |
| JP | 2004-117469 | 4/2004 |
| JP | 2006-47934 | 2/2006 |
| JP | 3883177 | 11/2006 |

* cited by examiner

*Primary Examiner*—David P Porta
*Assistant Examiner*—Kiho Kim
(74) *Attorney, Agent, or Firm*—Oblon, Spivak, McClelland, Maier & Neustadt, L.L.P.

(57) ABSTRACT

A support unit supports a rotation axe of each of at least three latent-image carriers in a rotatable manner. A plurality of developing units develops latent images on the latent-image carriers with toners of different colors, respectively. A toner-pattern detecting unit detects a toner pattern formed on a belt member that is suspended by a plurality of suspending members. A displacing unit is provided to the support unit to displace the rotation axis along a surface of the belt member in a direction of movement of the surface of the belt member. A control unit controls the displacing unit based of a result of detecting the toner pattern by the toner-pattern detecting unit.

10 Claims, 5 Drawing Sheets

IMAGE FORMING APPARATUS AND LATENT-IMAGE-CARRIER POSITION ADJUSTING METHOD

CROSS-REFERENCE TO RELATED APPLICATIONS

The present application claims priority to and incorporates by reference the entire contents of Japanese priority document 2006-331338 filed in Japan on Dec. 8, 2006.

BACKGROUND OF THE INVENTION

1. Field of the Invention

The present invention relates to an image forming apparatus, such as a copier, a facsimile, and a printer, which transfers toner images formed on a plurality of latent-image carriers, on an endless moving body such as an intermediate transfer belt or on a recording medium held on the surface of the moving body to obtain an superimposed image and a latent-image-carrier position adjusting method for the image forming apparatus.

2. Description of the Related Art

A typical color image forming apparatus includes a plurality of image forming units and successively transfers images of different colors on a recording paper through an intermediate transfer belt. In this type of image forming apparatus, latent-image carriers can be out of parallelism due to a skew in members of the apparatus depending on the accuracy of the respective components or in assembling the apparatus or a change of the temperature. In such cases, a color misalignment occurs in a sub scanning direction (a direction of movement of the surface of the intermediate transfer belt that abuts the latent-image carriers) for a color image formed by superimposing images of respective colors on an intermediate transfer belt.

In an image forming apparatus described in Japanese Patent Application Laid-open No. 2000-347474, photosensitive drums that are latent-image carriers as image forming modules of different colors, and a laser scanner unit that exposes the photosensitive drums are formed integrally. The adjacent image forming modules are contacted each other to keep a proper parallelism between the photosensitive drums, thereby suppressing a color misalignment in the color image. When the photosensitive drums are out of parallelism due to the a skew caused by a change of the temperature, a voltage is applied to a piezoelectric element that is provided between the adjacent image forming modules, based on a result of detection of toner images of different colors for detection, formed on the intermediate transfer belt from the photosensitive drums. Accordingly, the distance between the image forming modules is adjusted to correct the parallelism between the photosensitive drums.

The image forming apparatus described in Japanese Patent Application Laid-open No. 2000-347474 is based on the assumption that the accuracies of members that are produced by the same production processes and of image forming modules assembled by the same assembly processes are the same, and the same members at the same positions in the corresponding image forming modules have the same skew caused by the change of the temperature. However, even when the same production processes or assembly processes have been undergone, it is hard to achieve the same accuracy or skew associated with the image forming modules. Particularly, when the members are mass-produced, the difficulty is considerably large. Practically, for example, a longitudinal direction of the photosensitive drum and a longitudinal direction of the image forming module may not be parallel depending on the accuracies or skews of the members that configure the image forming module. In this case, an adjusted amount of a distance between the image forming modules and an adjusted amount of a position of the photosensitive drum required to correct the parallelism between the photosensitive drums have a difference. Therefore, even when the parallelism between the respective photosensitive drums is corrected by adjusting the distance between the adjacent image forming modules, like in the image forming apparatus described in Japanese Patent Application Laid-open No. 2000-347474, the parallelism between the respective photosensitive drums cannot be corrected accurately. Accordingly, the color misalignment in the sub scanning direction of a color image cannot be properly suppressed. Even when the same accuracy can be achieved in the respective image forming modules, the cost required for production of one apparatus becomes quite high.

SUMMARY OF THE INVENTION

It is an object of the present invention to at least partially solve the problems in the conventional technology.

An image forming apparatus according to one aspect of the present invention includes at least three latent-image carriers on each of which a latent image is formed; a support unit that supports a rotation axe of each of the latent-image carriers in a rotatable manner; a plurality of developing units for developing latent images formed on the latent-image carriers with toners of different colors, respectively; a toner-pattern detecting unit that detects a toner pattern formed on a belt member that is suspended by a plurality of suspending members; a displacing unit that is provided to the support unit to displace the rotation axis along a surface of the belt member in a movement direction of the surface of the belt member; and a control unit that controls the displacing unit based of a result of detecting the toner pattern by the toner-pattern detecting unit.

A method according to another aspect of the present invention is for adjusting a position of a latent-image carrier for an image forming apparatus that includes at least three latent-image carriers on each of which a latent image is formed, a support unit that supports a rotation axe of each of the latent-image carriers in a rotatable manner, a plurality of developing units for developing latent images formed on the latent-image carriers with toners of different colors, respectively, and a toner-pattern detecting unit that detects a toner pattern formed on a belt member that is suspended by a plurality of suspending members. The method includes adjusting the position of the latent-image carrier in a movement direction of the surface of the belt member by controlling a displacing unit that is provided to the support unit to displace the rotation axis along a surface of the belt member in the movement direction of the surface of the belt member based of a result of detecting the toner pattern by the toner-pattern detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 2:
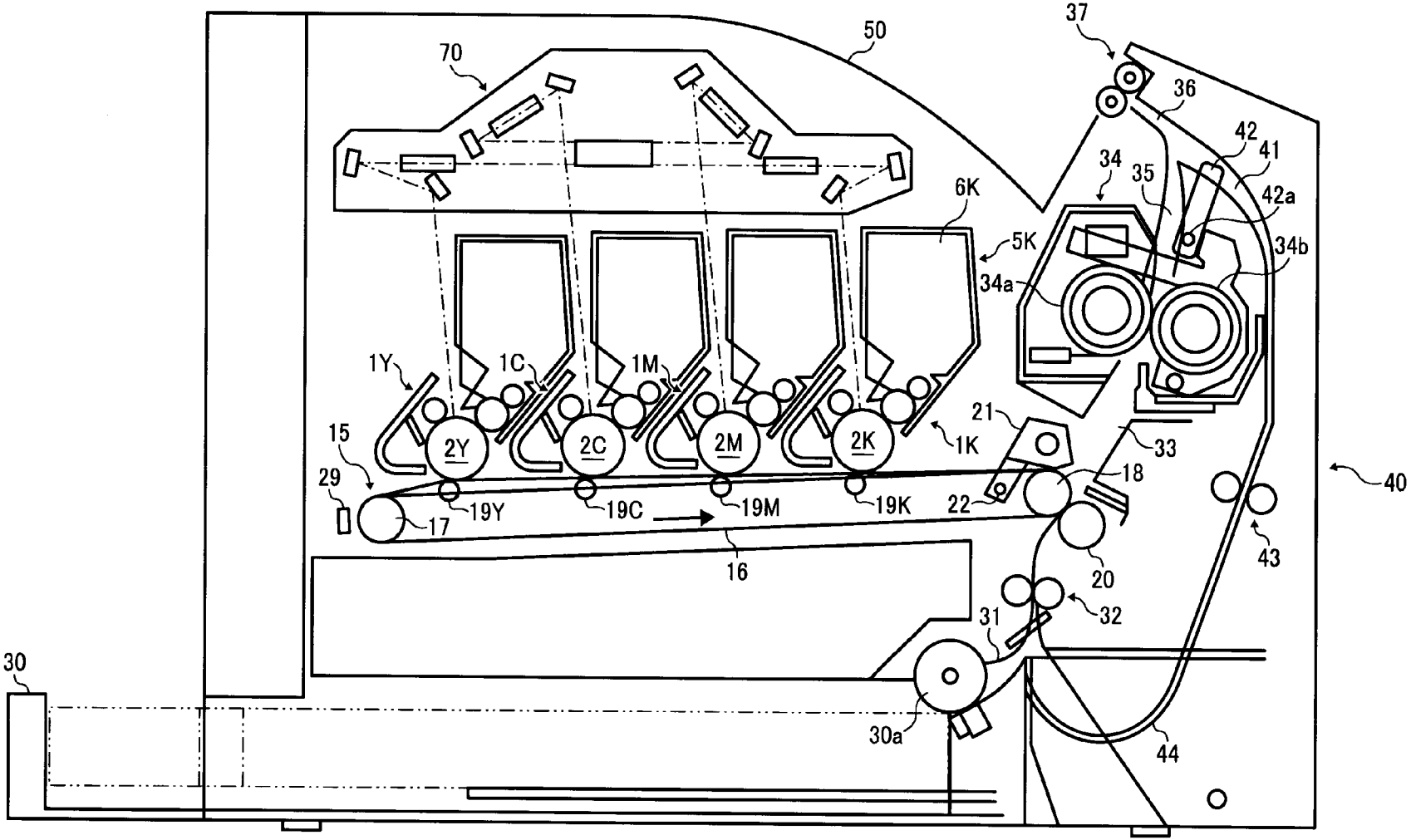
FIG. 2 is a schematic diagram of a printer according to an embodiment of the present invention.

FIG. 2 is a schematic diagram of an electrophotographic printer (hereinafter, "a printer") as an image forming apparatus. In FIG. 2, the printer includes four process units 1Y, 1M, 1C, and 1K for forming toner images of yellow (Y), magenta (M), cyan (C), and black (K). While using Y, M, C, and K toners of different colors as image forming materials, these process units have the same configurations except for this point, and are replaced at the end of life. For example, the process unit 1K for forming K toner images includes a photosensitive element 2K in the form of a drum as a latent-image carrier, a cleaning unit 3K, a neutralizing unit (not shown), a charging unit 4K, a developing unit 5K, and the like. The process unit 1K as an image forming unit can be attached to or removed from the printer body, and consumable parts can be replaced at once.

In FIG. 2, an optical writing unit 70 is placed above the process units 1Y, 1M, 1C, and 1K in the vertical direction. The optical writing unit 70 as a latent image writing device optically scans photosensitive elements 2Y, 2M, 2C, and 2K in the process units 1Y, 1M, 1C, and 1K, using a laser light L emitted from a laser diode based on image information. The optical scanning forms Y, M, C, and K electrostatic latent images on the photosensitive elements 2Y, 2M, 2C, and 2K. In this configuration, the optical writing unit 70 and the process units 1Y, 1M, 1C, and 1K serve as an imaging unit that creates Y, M, C, and K toner images as visible images of different colors on three or more latent-image carriers.

The optical writing unit 70 makes the laser light L emitted from a light source polarize in a main scanning direction using a polygon mirror that is rotatably driven by a motor (not shown), and applies the polarized light to the photosensitive elements through plural optical lens or mirrors. The optical writing unit 70 can perform optical writing with lights emitted from a plurality of light-emitting diodes (LEDs) of an LED array.

Below the process units 1Y, 1M, 1C, and 1K in the vertical direction, a transfer unit 15 is located which suspends an endless intermediate transfer belt 16 in a tensioned state and endlessly moves the intermediate transfer belt 16 counterclockwise in FIG. 2. The transfer unit 15 includes, in addition to the intermediate transfer belt 16, a driving roller 17, a driven roller 18, four first transfer rollers 19Y, 19M, 19C, and 19K, a second transfer roller 20, a belt cleaning unit 21, a cleaning backup roller 22, and the like.

The intermediate transfer belt 16 is suspended by the driving roller 17, the driven roller 18, the cleaning backup roller 22, and the first transfer rollers 19Y, 19M, 19C, and 19K, which are provided inside the loop of the intermediate transfer belt 16. The intermediate transfer belt 16 is moved endlessly in the same direction by a torque of the driving roller 17 that is rotatably driven counterclockwise in FIG. 2 by a driving unit (not shown).

The first transfer rollers 19Y, 19M, 19C, and 19K sandwich the intermediate transfer belt 16 that is endlessly moved, with the photosensitive elements 2Y, 2M, 2C, and 2K, which forms Y, M, C, and K first transfer nips, at which the front surface of the intermediate transfer belt 16 and the photosensitive elements 2Y, 2M, 2C, and 2K abut, respectively.

A first transfer bias is applied to the first transfer rollers 19Y, 19M, 19C, and 19K, respectively, by a transfer bias supply (not shown). Accordingly, a transfer electric field is formed between electrostatic latent images of the photosensitive elements 2Y, 2M, 2C, and 2K and the first transfer rollers 19Y, 19M, 19C, and 19K. Instead of the first transfer rollers 19Y, 19M, 19C, and 19K, a transfer charger or a transfer brush can be used.

When the Y toner image formed on the surface of the photosensitive element 2Y of the process unit 1Y moves into the Y first transfer nip along with the rotation of the photosensitive element 2Y, the toner is first transferred from the photosensitive element 2Y to the intermediate transfer belt 16 by the effect of the transfer electric field or the nip pressure. When the intermediate transfer belt 16 on which the Y toner image is first transferred passes through the M, C, and K first transfer nips along with its endless rotation, the M, C, and K toner images on the photosensitive elements 2M, 2C, and 2K are successively superimposed on the Y toner image, and first transferred. This superimposing first transfer forms a four-color toner image on the intermediate transfer belt 16.

The second transfer roller 20 of the transfer unit 15 is provided outside the loop of the intermediate transfer belt 16, and sandwiches the intermediate transfer belt 16 with the driven roller 18 inside the loop. This sandwiching forms a second transfer nip at which the front surface of the intermediate transfer belt 16 and the second transfer roller 20 abut. A second transfer bias is applied to the second transfer roller 20 by a transfer bias supply (not shown). This application forms a second transfer electric field between the second transfer roller 20 and the driven roller 18 that is connected to the ground.

A feed cassette 30 that contains plural pieces of recording paper P stacked in a pile is located below the transfer unit 15 in the vertical direction, to be slidingly attached to or removed from the housing of the printer. The feed cassette 30 brings a feed roller 30*a* into contact with the recording paper P at the top of the pile, and rotates the feed roller 30*a* counterclockwise in FIG. 2 at predetermined timing to convey the recording paper P to a feed path 31.

A pair of registration rollers 32 is provided near an end of the feed path 31. The registration rollers 32 stop rotation of the rollers as soon as the recording paper P sent out from the feed cassette 30 is sandwiched between the rollers. The registration rollers 32 resume the rotational driving at timing when the recording paper P can be synchronized with the four-color toner image on the intermediate transfer belt 16 within the second transfer nip, and conveys the recording paper P toward the second transfer nip.

The four-color toner image on the intermediate transfer belt 16 stuck on the recording paper P at the second transfer nip is second transferred collectively on the recording paper P under the effect of the second transfer electric field or the nip pressure, and combined with white color of the recording paper P, resulting in a full-color toner image. When passed through the second transfer nip, the recording paper P having the surface on which the full-color toner image is formed self-strips from the second transfer roller 20 and the intermediate transfer belt 16. The recording paper P is passed through a post-transfer path 33, and fed to a fixing device 34.

Remaining toner that has not been transferred to the recording paper P adheres to the intermediate transfer belt 16 after passing through the second transfer nip. The remaining toner is cleaned from the belt surface by the belt cleaning unit 21 that abuts against the front surface of the intermediate transfer belt 16. The cleaning backup roller 22 provided inside the loop of the intermediate transfer belt 16 backs up the cleaning of the belt by the belt cleaning unit 21 from the inside of the loop.

The fixing device 34 forms a fixing nip by a fixing roller 34*a* that includes a heat source such as a halogen lamp (not shown), and a pressure roller 34*b* that rotates abutting on the fixing roller 34*a* with a predetermined pressure. The recording paper P conveyed in the fixing device 34 is sandwiched by the fixing nip, with a face on which an unfixed toner image is carried being firmly attached to the fixing roller 34*a*. Toner of the toner image is softened by application of heat or pressure, and the full-color image is fixed.

After passed through a post-fixture path 35, the recording paper P discharged from the fixing device 34 comes to a branch point between a discharging path 36 and a pre-reverse path 41. A switching pawl 42 that is driven rotatably around a rotation axis 42*a* is provided on the side of the post-fixture path 35. The rotation of the switching pawl 42 closes or opens near the end of the post-fixture path 35. At timing when the recording paper P is sent out from the fixing device 34, the switching pawl 42 stops at a rotational position indicated by a full line in FIG. 2, to open near the end of the post-fixture path 35. Thus, the recording paper P moves from the post-fixture path 35 into the discharging path 36, to be sandwiched between rollers of a pair of discharge rollers 37.

When a one-side printing mode is set through an input operation to an operation unit including a numerical keypad (not shown) and the like or by a control signal transmitted from a personal computer (not shown) or the like, the recording paper P sandwiched by the discharge rollers 37 is discharged directly from the apparatus. The discharged paper P is stacked on a stack unit that is a top face of a top cover 50 of the housing.

Meanwhile, when a two-sided printing mode is set, the switching pawl 42 rotates up to a position indicated by a dashed-dotted line in FIG. 2 to close near the end of the post-fixture path 35 when the rear end of the recording paper P that is conveyed through the discharging path 36 passes through the post-fixture path 35 with the front end of the paper being sandwiched by the discharge rollers 37. Almost at the same time, the discharge rollers 37 starts reverse rotation. Accordingly, the recording paper P is conveyed directing the rear end forward, and moves in the pre-reverse path 41.

The right end of the printer in FIG. 2 forms a reversing unit 40 that turns around a turning axis 40*a* to open or close with respect to the housing body. When the discharge rollers 37 reversely rotates, the recording paper P moves in the pre-reverse path 41 of the reversing unit 40, and conveyed from the upper side to the lower side in the vertical direction. After passed through between rollers of a pair of inverse conveying rollers 43, the recording paper P moves in a reversing path 44 that curves in a semicircle. With the conveyance along the curved shape, the upper and lower surfaces of the recording paper P is reversed, while the direction of movement of the recording paper P from the upper side to the lower side in the vertical direction is reversed, so that the recording paper P is conveyed from the lower side to the upper side in the vertical direction. The recording paper P passes through the feed path 31, and moves in the second transfer nip again. A full-color image is second transferred collectively on the other surface, and the recording paper P passes through the post-transfer path 33, the fixing device 34, the post-fixture path 35, the discharging path 36, and the discharge rollers 37 successively, to be discharged from the apparatus.

On the left hand of the intermediate transfer belt 16 in FIG. 2, an optical sensor unit 29 is located, facing a position where the intermediate transfer belt 16 is suspended on the driving roller 17 with a predetermined gap apart from the front surface of the intermediate transfer belt 16. The optical sensor unit 29 detects patch images (rectangular solid toner images) in an image for detecting misalignment formed on the intermediate transfer belt 16.

Figure 3:
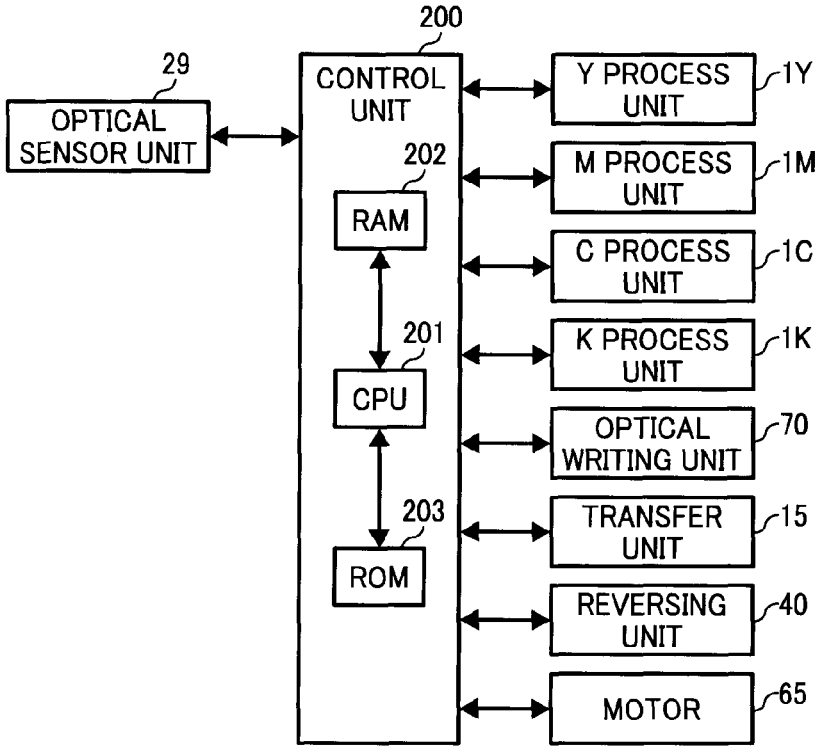
FIG. 3 is a block diagram of relevant parts of an electric circuit.

FIG. 3 is a block diagram of relevant parts of an electric circuit of the printer. In FIG. 3, a control unit 200 includes a central processing unit (CPU) 201 as a computing unit, a nonvolatile random access memory (RAM) 202 as a data storage unit, a read only memory (ROM) 203 as a data storage unit, and the like. The process units 1Y, 1M, 1C, and 1K, the optical writing unit 70, the transfer unit 15, the reversing unit 40, the optical sensor unit 29, and the like are electrically connected to the control unit 200. The control unit 200 controls these components based on a control program stored in the RAM 202 or the ROM 203.

In the RAM 202, data of Y, M, C, and K developing biases values, data of Y, M, C, and K drum charging potentials, and the like corresponding to the process units 1Y, 1M, 1C, and 1K are stored, in addition to the control program.

At the normal printing process, the control unit 200 performs control of applying charging biases corresponding to the Y, M, C, and K drum charging potentials stored in the RAM 202 to corresponding charging units in the process units 1Y, 1M, 1C, and 1K, respectively. Accordingly, the photosensitive elements 2Y, 2M, 2C, and 2K of the respective colors are uniformly charged to the Y, M, C, and K drum charging potentials. The control unit 200 performs control of applying the developing biases of the Y, M, C, and K developing bias values to the corresponding developing rollers in the process units 1Y, 1M, 1C, and 1K, during the printing process. This causes a developing potential that electrostatically moves the toner from the surfaces of developing sleeves to the photosensitive elements 2Y, 2M, 2C, and 2K to operate between the electrostatic latent images of the photosensitive elements and the developing sleep, thereby developing the electrostatic latent images.

The control unit 200 performs imaging-condition correcting control called process control, when a heating roller temperature (fixing temperature) that is 60° C. or less is detected immediately after turning-on of the main power supply (not shown) or each time predetermined pieces of paper is printed. In the process control, a developing-bias correcting process that corrects developing biases in the developing units for the respective colors, and an aligning process that performs alignment by detecting skew distortion or a difference in the magnification ratio among the toner images of respective colors and correcting various settings are performed. When the heating roller temperature above 60° C. is detected even immediately after the turning-on of the main power supply, the process control is not performed. Thus, when the time from turning-off to turning-on of the main power supply is relatively short, for example several minutes to several tens of minutes, the process control is omitted. This eliminates a situation where the user is forced to wait unnecessarily due to excess tests, or a situation where the power or toner is consumed wastefully.

In the developing-bias correcting process in the process control, the photosensitive elements 2Y, 2M, 2C, and 2K shown in FIG. 2 are rotated to be uniformly charged. The charged potential is gradually increased, unlike the uniform drum charging potential in the printing process. Ten patch electrostatic latent images for forming a tone pattern image are formed on the photosensitive elements 2Y, 2M, 2C, and 2K, respectively, by scanning with laser light, and these images are developed by Y, M, C, and K developing units. At the development, the control unit 200 gradually increases the developing bias values applied to the Y, M, C, and K developing sleeves. This development forms Y, M, C, and K tone pattern images on the photosensitive elements 2Y, 2M, 2C, and 2K. These images are first transferred on the intermediate transfer belt 16 to be arranged in the order of K, C, M, and Y from the downstream to the upstream in the belt moving direction. Accordingly, a test pattern image for detecting the amount of adhered toner including four (K, C, M, and Y) tone pattern images successively arranged is formed.

Figure 4:
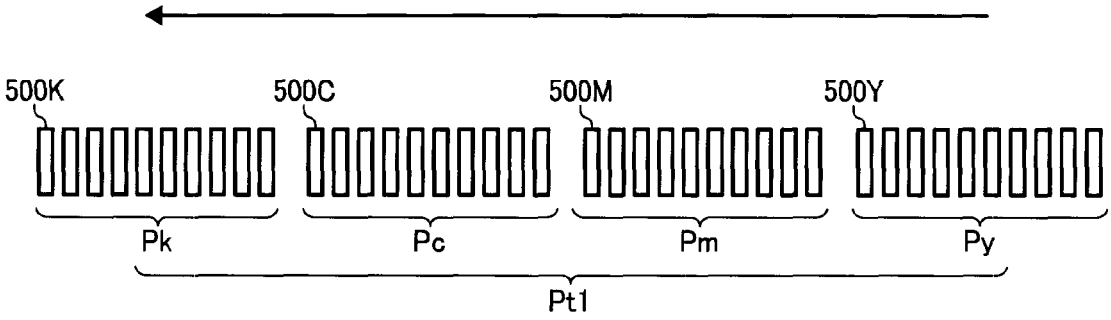
FIG. 4 is a schematic plan view of a test pattern image for detecting an amount of adhered toner, formed on an intermediate transfer belt.

FIG. 4 is a schematic plan view of the test pattern image for detecting the amount of adhered toner, formed on the intermediate transfer belt 16. An arrowed line in FIG. 4 indicates the moving direction of the surface of the intermediate transfer belt 16 (not shown). A test pattern image Pt1 includes a K-tone pattern image Pk, a C-tone pattern image Pc, an M-tone pattern image Pm, and a Y-tone pattern image Py, arranged in this order from the downstream to the upstream in the belt moving direction. Each of the tone pattern images includes ten patch images (500K, 500C, 500K, and 500Y) arranged at a predetermined pitch in the belt moving direction.

The ten patch images 500Y, 500M, 500C, and 500K in the tone pattern images Py, Pm, Pc, and Pk of the respective colors Y, M, C, and K are developed according to combinations of different drum charging potentials and developing biases, respectively. The amounts of toner adhered (image density) per unit area of these patch images are gradually increased. The amount of adhered toner has a correlation with a developing potential that is a difference between the drum charging potential and the developing bias. Therefore, the relation therebetween is represented by an approximately straight line graph on the two-dimensional coordinate. Thus, when a function ($y=ax+b$) representing the straight graph is calculated by a regression analysis based on the result of detection of the amount of adhered toner in each patch image, a developing bias value that achieves a desired image density (the amount of adhered toner) can be obtained.

Figure 5:
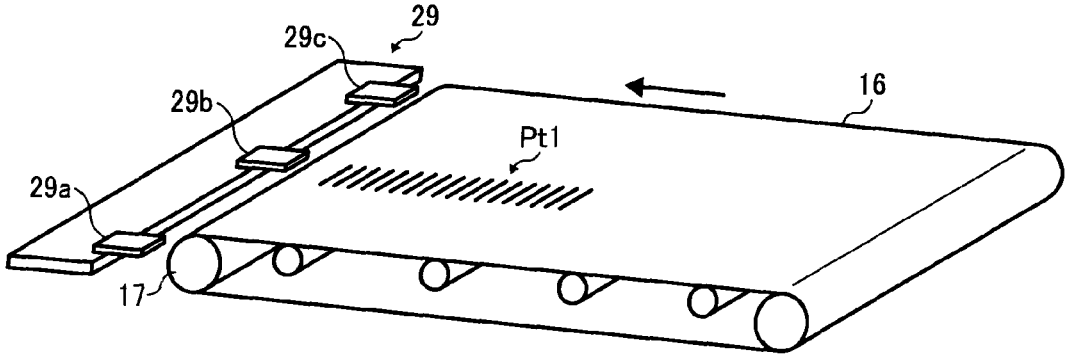
FIG. 5 is a perspective view of an intermediate transfer belt and the surrounding thereof.

FIG. 5 is a perspective view of the intermediate transfer belt 16 of the printer. As described above, the optical sensor unit 29 is provided on the left hand of the intermediate transfer belt 16. The optical sensor unit 29 includes a one-end sensor 29*a* that detects patch images formed at one end in the width direction of the intermediate transfer belt 16, a central sensor 29*b* that detects patch images formed at the center in the width direction, and an other-end sensor 29*c* that detects patch images formed on the other end in the width direction. Each of these sensors detects reflected light obtained by reflecting light emitted from an emitter on the surface of the belt, using a photodetector. Because the optical reflectance is greatly different between a solid surface of the belt and the patch image, the patch image can be detected based on the change in the amount of received light. The optical reflectance of the patch image varies according to the amount of adhered toner. Therefore, the amount of adhered toner can be detected based on the amount of received light. Each of the sensors 29*a*, 29*b*, and 29*c* outputs a signal corresponding to the amount of received light, and the output signal is inputted to the control unit 200 through an analog-to-digital converter (not shown).

The test pattern image Pt1 for detecting the amount of adhered toner is formed on the front surface of the intermediate transfer belt 16 at the center in the width direction, as shown in FIG. 5. The patch images 500K, 500C, 500M, and 500Y of the respective tone pattern images Pk, Pc, Pm, and Py of the test pattern image Pt1 pass through a position opposing the central sensor 29*b* along with the endless movement of the intermediate transfer belt 16. The central sensor 29*b* receives an amount of light corresponding to the amount of adhered toner per unit area for the patch images. An output signal from the central sensor 29*b* is inputted to the control unit 200 as a digital signal. Accordingly, the control unit 200 can recognize the amount of adhered toner per unit area for the respective patch images, based on the digital signal.

The control unit 200 successively calculates the image density (the amount of adhered toner) of the respective patch images based on the output signals corresponding to the patch images, which are successively transmitted from the central sensor 29*b*, and stores the calculated image density in the RAM 202. The control unit 200 performs a regression analysis using the developing bias values and image density data of the ten patch images with respect to the respective colors of Y, M, C, and K, and obtains a function (regression expression) representing the straight line graph on the two-dimensional coordinate. The control unit 200 assigns a target value of the image density to the function to calculate a proper developing bias value, and stores the calculated value as Y, M, C, and K correction developing bias values in the RAM 202.

In the RAM 202, an imaging condition-data table is stored in which several tens of developing bias values and appropriate drum charging potentials corresponding thereto are previously related to each other. The control unit 200 selects developing bias values that are closest to the correction developing bias values from the imaging condition-data table for the process units 1Y, 1M, 1C, and 1K, and identifies the drum charging potentials related thereto. The identified drum charging potentials are stored in the RAM 202 as the Y, M, C, and K correction drum charging potentials. When all the correction developing bias values and the correction drum charging potentials are stored in the RAM 202, the control unit 200 corrects data of the Y, M, C, and K developing bias values to values equivalent to the corresponding correction developing bias values, and re-stores the values. The Y, M, C, and K drum charging potentials are corrected to values equivalent to the corresponding correction drum charging potentials, and re-stored. According to this correction, the imaging conditions for toner-image forming units 100Y, 100M, 100C, and 100K at the printing process can be corrected to conditions that enable to form toner images of desired image density.

The test pattern image Pt1 for detecting the amount of adhered toner after passing through the position opposing the optical sensor unit 29 along with the endless movement of the intermediate transfer belt 16 is removed from the front surface of the intermediate transfer belt 16 by the belt cleaning unit 21 as shown in FIG. 2.

When correcting the developing biases for the respective colors by the developing-bias correcting process, the control unit 200 performs an aligning process of detecting misalignment of the toner images of the respective colors and aligning the toner images.

Figure 6:
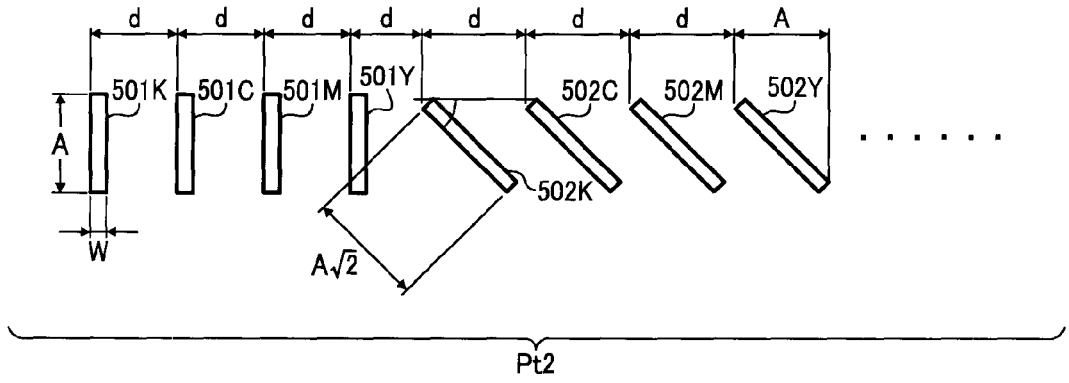
FIG. 6 is a schematic plan view of a test pattern image for detecting a misalignment.
Figure 7:
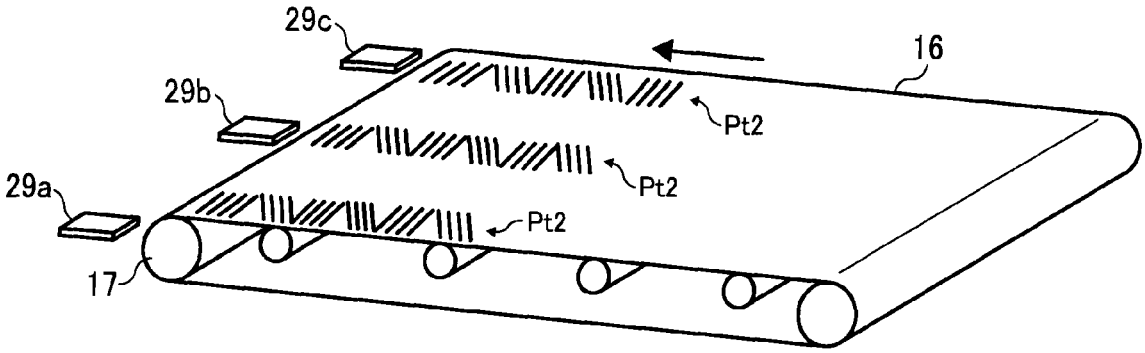
FIG. 7 is a perspective view of the intermediate transfer belt, on which test pattern images for detecting a misalignment are formed.

In the aligning process, a test pattern image Pt2 for detecting misalignment as shown in FIG. 6 is formed on the intermediate transfer belt 16. The test pattern image Pt2 for detecting misalignment is formed by arranging a predetermined number of patterns each being composed of eight patch images including four vertically-extending patch images 501K, 501C, 501M, and 501Y arranged in the belt moving direction and four inclined patch images 502K, 502C, 502M, and 502Y arranged subsequently. The test pattern images Pt2 configured as above are formed at one end, the center, and the other end of the intermediate transfer belt 16 in the belt moving direction, as shown in FIG. 7. The test pattern image Pt2 formed at one end is detected by the one-end sensor 29*a* along with the endless movement of the intermediate transfer belt 16. The test pattern image Pt2 formed at the center is detected by the central sensor 29*b*. The test pattern image Pt2 formed at the other end is detected by the other-end sensor 29*c*.

The vertically-extending patch images 501K, 501C, 501M, and 501Y of the test pattern image Pt2 for detecting misalignment each have a shape extending straight in a direction that is perpendicular to the moving direction (in the width direction of the belt) on the front surface of the intermediate transfer belt 16, as shown in FIG. 6. These four vertically-extending patch images 501K, 501C, 501M, and 501Y are formed to be arranged with a pitch of a distance d, and have a width W in the belt moving direction. When the patch images are misaligned in the sub scanning direction, the distance d has some error.

The inclined patch images 502K, 502C, 502M, and 502Y of the test pattern image Pt2 each have a shape extending in a direction inclined at 45° C. with respect to the belt width direction. These patch images each have a length A in the belt moving direction and a length $A\times\sqrt{2}$ in the extending direction. The arrangement pitch in the belt moving direction is the same distance d as that of the vertically-extending patch image. The lengths A and $A\times 2$, and the distance d have errors when the inclination of the optical system of the optical writing unit changes due to an increase in the temperature. This is because skew distortion or an error of the magnification ratio in the main scanning direction occurs in the patch images.

As shown in FIG. 7, three of the test pattern images Pt2 having the configuration mentioned above are formed in the width direction on the intermediate transfer belt 16. The patch images of each pattern are formed in alignment in the belt width direction when no misalignment in the sub scanning direction (belt moving direction) occurs. In each of the test pattern images Pt2, the vertically-extending patch images 501K, 501C, 501M, and 501Y and the inclined patch images 502K, 502C, 502M, and 502Y are formed in alignment in the belt moving direction. Therefore, the three sensors 29*a* to 29*c* normally detect the vertically-extending patch images 501K, 501C, 501M, and 501Y and the inclined patch images 502K, 502C, 502M, and 502M at the same timing, respectively. When these patch images are not detected at the same timing, it indicates that the patch images are misaligned in the sub scanning direction.

Figure 1:
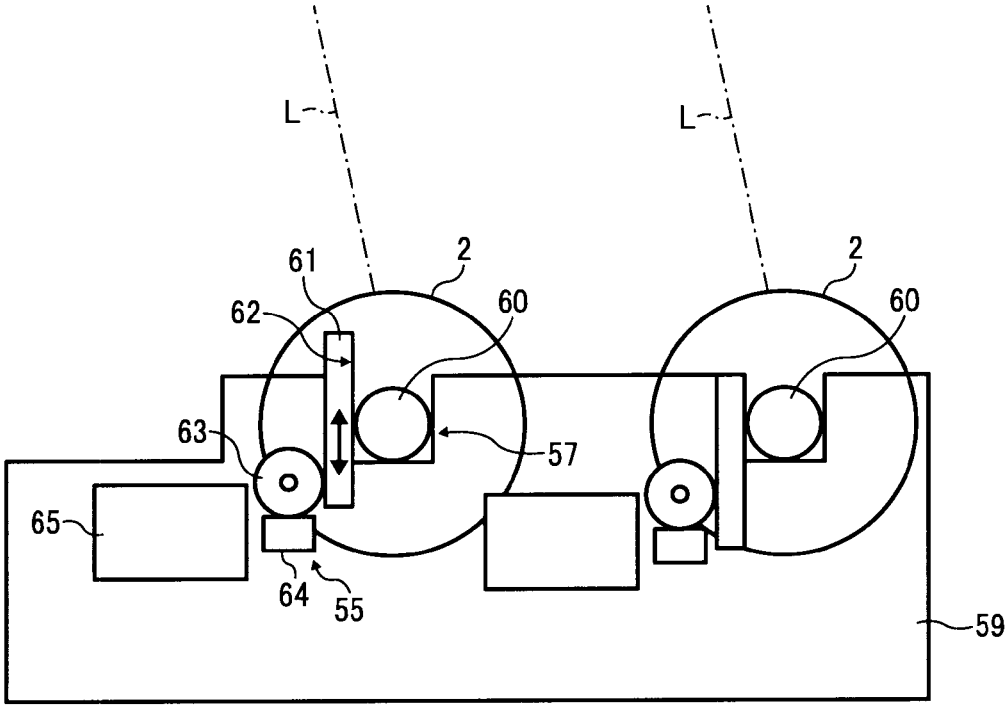
FIG. 1 is a schematic diagram of photosensitive elements and the surrounding thereof when a displacing unit as a characteristics part of the present invention is provided.

Optical beams L emitted by the optical writing unit 70 are applied to the photosensitive elements 2 in positional relations as shown in FIG. 1. A rotation axis 60 of the photosensitive element 2 is set to a support unit 57 between a frame 59 and a positioning inclined member 61. The opposite end of the rotation axis 60 in the longitudinal direction is supported by a frame 58 of a support unit 56.

The positioning inclined member 61 configures a displacing unit 55 that displaces the rotation axis 60 toward the moving direction of the surface of the intermediate transfer belt 16, along the surface of the intermediate transfer belt 16. As shown in FIG. 1, the positioning inclined member 61 is adapted to move upward or downward in a state that an inclined unit 62 of the positioning inclined member 61 abuts the rotation axis 60 in the direction mentioned above. The displacing unit 55 includes, in addition to the positioning inclined member 61, a rack gear 63 provided to the positioning inclined member 61, a pinion gear 64 that engages the rack gear 63, and a motor 65 that drives the pinion gear 64. In the present embodiment, the inclined unit 62 has an inclination of 150 micrometers, and is inclined at a predetermined angle to the direction as mentioned above. The configuration of the displacing unit 55 is not limited thereto.

Correction of a color misalignment occurring in the sub scanning direction of the color image is explained below.

When a color misalignment occurring in the sub scanning direction of the color image is detected by the optical sensor unit 29 according to the misalignment detection for the respective patch images of the test pattern image Pt2 for detecting misalignment, formed on the intermediate transfer belt 16, the control unit 200 adjusts the position of the rotation axis 60 in the sub scanning direction using the displacing unit 55, based on the result of the detection. Accordingly, the parallelism between the photosensitive elements is corrected properly, so that the color misalignment can be suppressed.

For example, based on the result of the detection by the optical sensor unit 29, the control unit 200 moves the positioning inclined member 61 upward or downward by driving force supplied by the motor 65 through the pinion gear 64 and the rack gear 63, and changes the thickness of a portion of the positioning inclined member 61 contacting the rotation axis 60. Accordingly, the control unit 200 changes the distance of a contact point between the rotation axis 60 and the frame 59 across the positioning inclined member 61 in the support unit 57. In this way, the position of the rotation axis 60 in the sub scanning direction can be directly adjusted. When the position of the rotation axis 60 in the sub scanning direction is directly changed by the displacing unit 55 based on the result of the detection by the optical sensor unit 29, the parallelism between the photosensitive elements can be corrected easily and highly accurately. In the present embodiment, the positioning inclined member 61 has an inclination of about 150 micrometers. Therefore, the positions of the respective rotation axes in the sub scanning direction can be adjusted by a range of 0 to 150 micrometers.

When the parallelism between the photosensitive elements 2 is adjusted by 10 micrometers according to the method mentioned above, an inclination of 20 micrometers that is twice as high as the adjusted 10 micrometers is adjusted on the color image formed on the recording paper P. Accordingly, with respect to a color misalignment in the misalignment detecting patterns of the respective colors, formed on the intermediate transfer belt 16, which color misalignment is detected by the optical sensor unit 29, the parallelism between the photosensitive elements is made appropriate by adjusting the position of the rotation axis 60 in the sub scanning direction by an amount corresponding to half of the color misalignment. Therefore, the color misalignment in the sub scanning direction of the color image can be properly corrected.

Figure 8:
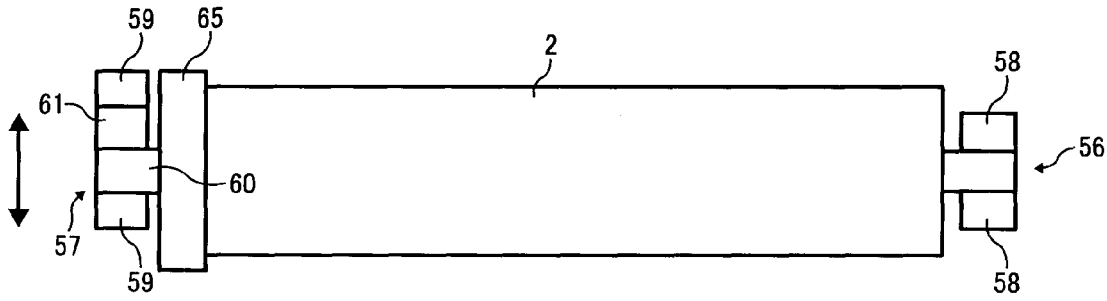
FIG. 8 is a top schematic diagram when a positioning inclined member is placed on a driving side of a photosensitive element.

As shown in FIG. 8, at the longitudinal end of the rotation axis 60 on the side of driving the photosensitive element 2, i.e., the side on which a photosensitive element gear 67 and the like are provided, driving force supplied from a driving device (not shown) through the photosensitive element gear 67 and a photosensitive-element driving gear 66 is applied. Accordingly, force resulting from the driving force, for example force pressing the rotation axis 60 upward in FIG. 8 is applied. Therefore, when the positioning inclined member 61 is provided at a position where the rotation axis 60 can press the positioning inclined member 61 with the force resulting from the driving force, the adjusted position of the rotation axis 60 in the direction mentioned above can be stably kept. Thus, a state after correction of the parallelism between the photosensitive elements can be maintained.

Figure 9:
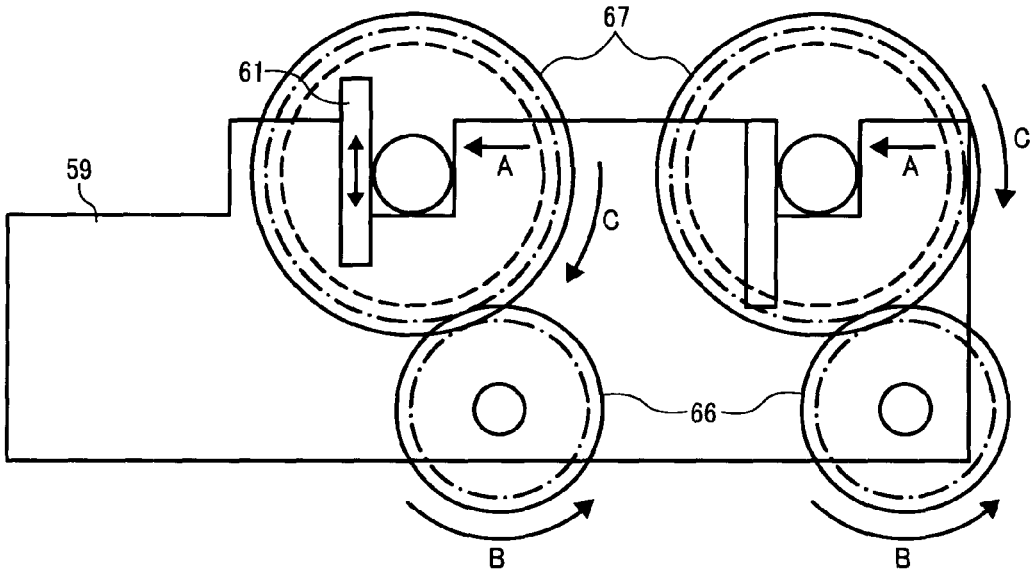
FIG. 9 is a side schematic diagram when the positioning inclined member is placed on the driving side of the photosensitive element.

By referring to FIG. 9, when the photosensitive element gear 67 is rotated in the direction indicated by an arrow C along with the rotation of the photosensitive-element driving gear 66 in the direction indicated by an arrow B, force in the direction indicated by an arrow A is applied to the rotation axis 60 of the photosensitive element 2. Accordingly, when the positioning inclined member 61 is placed in a position as shown in FIG. 9, the rotation axis 60 biased in the direction of the arrow A strongly presses the positioning inclined member 61. Thus, the position of the rotation axis 60 in the direction mentioned above can be maintained. In this way, the inclination, i.e., the parallelism of the photosensitive element 2 can be stably kept along the inclined unit 62 of the positioning inclined member 61.

A printer that forms color images using four colors of magenta, yellow, cyan, and black like the printer according to the present embodiment can have a configuration in which the position of the rotation axis 60 of the photosensitive element 2M that forms magenta images in the direction mentioned above is determined by positioning of the frame 59, and the displacing units 55 are provided in the support units 57 that support the rotation axes 60 of the photosensitive elements 2 for the other colors, respectively. Even when the support unit 57 in one of the plural photosensitive elements 2 does not includes the displacing unit 55, the parallelism between the photosensitive elements can be corrected by providing the displacing units 55 to the support units 57 of other photosensitive elements 2, and adjusting the positions of the rotation axes 60 of the other photosensitive elements 2 in the direction mentioned above, with reference to the inclination of the rotation axis 60 of the photosensitive element 2 that does not include the displacing unit 55. Therefore, the number of the displacing units 55 to be provided can be reduced by one. Accordingly, the cost can be decreased and the space required in the apparatus body can be reduced.

When the support unit 57 in the photosensitive element 2M associated with formation of magenta images does not include the displacing unit 55, the color misalignment between magenta and cyan, or magenta and yellow at the formation of a second color can be reduced. Therefore, the visual color misalignment in the entire color image can be reduced.

Also in an image forming apparatus that forms color images using three colors of magenta, cyan, and yellow, the position of the rotation axis 60 of the photosensitive element 2M that forms magenta images in the direction mentioned above can be determined by positioning of the frame 59, and the support units 57 of the photosensitive elements 2 for other colors can include the displacing units 55. When the parallelism between other photosensitive elements 2 is adjusted with reference to the photosensitive element 2M for magenta, the number of the displacing units 55 can be reduced by one. Accordingly, the cost can be decreased, and the space required in the apparatus body can be reduced.

According to the present embodiment, a printer that is an image forming apparatus including at least three photosensitive elements 2 as latent-image carriers; support units 57 that rotatably support the rotation axes 60 of the photosensitive elements 2; plural developing units 5 that are plural developing units provided opposing the photosensitive elements 2, and develop latent images carried on the photosensitive elements 2 with toner of different colors, respectively; the intermediate transfer belt 16 that is a belt member suspended in a tensioned state by plural suspending members, provided at a position in contact with the photosensitive elements 2; and the optical sensor unit 29 as a toner-pattern detecting unit that detects patch images as toner patterns formed on the intermediate transfer belt 16 includes the displacing units 55 provided to the support units 57 to displace the rotation axis 60 in a moving direction of the surface of the intermediate transfer belt 16 along the surface of the intermediate transfer belt 16, and the control unit 200 as a control unit that controls the displacing units 55 based on a result of detection by the optical sensor unit 29. Therefore, even when the photosensitive elements 2 are out of parallelism, the position of the rotation axis 60 in the direction mentioned above can be directly adjusted by the displacing unit 55 based on the result of the detection by the optical sensor unit 29 to obtain an appropriate parallelism. Accordingly, the parallelism can be corrected accurately. Thus, a color misalignment in the sub scanning direction at the formation of color images occurring due to the photosensitive elements being out of parallelism can be suppressed.

Furthermore, according to the present embodiment, the positioning inclined member 61 as a positioning-adjusting inclined member that abuts the rotation axis 60 in the direction mentioned above at the inclined unit 62 having an inclination angle with respect to the direction is movably provided to the displacing unit 55. The control unit 200 moves the positioning inclined member 61 provided to the displacing unit 55, based on the result of the detection by the optical sensor unit 29, to adjust the position of the rotation axis 60 in the direction mentioned above. Accordingly, the parallelism between the photosensitive elements can be corrected with a quite simple configuration without complicating the inside of the apparatus body.

Moreover, according to the present embodiment, a driving device as a driving-force supplying unit that supplies driving force to the photosensitive element 2 through the photosensitive-element driving gear 66 as a driving gear, and the photosensitive element gear 67 as a gear to be driven that is provided to the rotation axis 60 and supplied with the driving force from the photosensitive-element driving gear 66 are provided on one of the longitudinal ends of the rotation axis 60. The displacing unit 55 is provided to the support unit 57 on the side at which the photosensitive element gear 67 is provided. Accordingly, when the positioning inclined member 61 abuts the rotation axis 60 in the direction mentioned above, for example as in the present embodiment, the rotation axis 60 is pressed to the positioning inclined member 61 by force in the direction mentioned above resulting from the driving force that is supplied from the driving device to the rotation axis 60 through the photosensitive-element driving gear 66 and the photosensitive element gear 67. Therefore, the position of the rotation axis 60 in the direction mentioned above can be stably kept, so that the parallelism between the photosensitive element can be properly maintained.

Furthermore, according to the present embodiment, the positioning inclined member 61 is provided on a side opposite in the direction mentioned above across the rotation axis 60 to the position at which the photosensitive-element driving gear 66 is provided. Accordingly, the rotation axis 60 can be made strongly abut the positioning inclined member 61 due to the force in the direction mentioned above resulting from the driving force. Therefore, the position of the rotation axis 60 in the direction can be kept more stably.

Moreover, according to the present embodiment, the displacing unit 55 includes at least the positioning inclined member 61, the rack gear 63 provided to the positioning inclined member 61, the pinion gear 64 engaging the rack gear 63, and the motor 65 as a driving unit that drives the pinion gear 64. The positioning inclined member 61 is adapted to move with the driving force from the motor 65, supplied through the pinion gear 64 and the rack gear 63. Accordingly, the positioning inclined member 61 can be moved with a quite simple configuration at low costs, without complicating near the support unit 57.

Furthermore, according to the present embodiment, the support unit 57 of one of the at least three photosensitive elements 2 does not include the displacing unit 55. Even when the support unit 57 of one of the plural photosensitive elements 2 does not include the displacing unit 55, the displacing units 55 provided to the support units 57 of other photosensitive elements 2 can correct the parallelism between the photosensitive elements, by adjusting the rotation axes 60 of the other photosensitive elements 2 with reference to an inclination in the direction mentioned above of the rotation axis 60 of the photosensitive element 2 that does not include the displacing unit 55. Therefore, the number of the displacing units 55 to be provided can be reduced by one. Thus, the cost reduction and the space saving in the apparatus body can be achieved.

Moreover, according to the present embodiment, the printer includes four of the photosensitive elements 2, and can form color images of four colors, i.e., magenta, cyan, yellow, and black. The support unit 57 of the photosensitive element 2 associated with formation of images of one of the four colors does not include the displacing unit 55. For example, when the support unit 57 of the photosensitive element 2M associated with formation of magenta images does not include the displacing unit 55, an inclination difference between magenta and cyan or magenta and yellow at the formation of a second color can be reduced. Thus, the visual color misalignment in the entire image can be reduced. Of course, even when this configuration is made for a color other than magenta, the same effect is obtained.

Furthermore, according to the present embodiment, color images are formed with three colors of magenta, cyan, and yellow. The support unit 57 of the photosensitive element 2 associated with formation of images of one of the three colors does not include the displacing unit 55. When the positions of the rotation axes 60 of other photosensitive elements 2 in the direction mentioned above are adjusted with reference to an inclination in the direction mentioned above of the rotation axis 60 of the photosensitive element 2 that does not include the displacing unit 55, the parallelism between the photosensitive elements 2 can be corrected. Thus, the number of the displacing units 55 provided in the apparatus body can be reduced by one. Accordingly, the cost reduction and the space saving in the apparatus body can be achieved. The visual color misalignment in a second color relative to the colors of the image formed on the photosensitive element 2 that does not include the displacing unit 55 can be reduced.

Moreover, according to the present embodiment, when the present invention is applied to a method of adjusting a position of a photosensitive element in a printer that includes at least three photosensitive elements 2, support units 57 that rotatably support the rotation axes 60 of the photosensitive elements 2, respectively, plural developing units 5 each being provided to face each of the photosensitive elements 2 and developing latent images carried on the photosensitive elements 2 with toner of difference colors, respectively, the intermediate transfer belt 16 that is suspended in a tensioned state by plural suspending members to be provided at a position in contact with the photosensitive elements 2, and the optical sensor unit 29 that detects patch images formed on the intermediate transfer belt 16, the parallelism between the photosensitive elements can be adjusted highly accurately at low costs and with a quite simple configuration.

While the printer using the intermediate transfer method has been explained in the present embodiment, image forming apparatuses to which the present invention can be applied are not limited thereto. The present invention can be applied to any image forming apparatus such as a printer that adopts a direct transfer method of transferring toner images directly from the photosensitive elements 2 to recording paper P carried by a transfer conveyer belt.

As described above, according to one aspect of the present invention, a controller controls a displacing unit provided to a support unit based on a result of detection of toner patterns by a toner-pattern detecting unit. Therefore, the position of a rotation axis in a direction that is parallel to a surface contacting latent-image carriers and a belt member and is perpendicular to the longitudinal direction of the rotation axis can be directly adjusted. Accordingly, even when a color misalignment occurs in the sub scanning direction of the color images because the latent-image carriers are out of parallelism, the position of the rotation axis in the direction mentioned above can be directly adjusted. Thus, the parallelism between the latent-image carriers can be corrected accurately, and the color misalignment of the color images in the sub scanning direction can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

at least three latent-image carriers on each of which a latent image is formed;

a support unit that supports a rotation axis of each of the latent-image carriers in a rotatable manner;

a plurality of developing units for developing latent images formed on the latent-image carriers with toners of different colors, respectively;

a toner-pattern detecting unit that detects a toner pattern formed on a belt member that is suspended by a plurality of suspending members;

a displacing unit that is provided to the support unit to displace the rotation axis along a surface of the belt member in a movement direction of the surface of the belt member; and a control unit that controls the displacing unit based of a result of detecting the toner pattern by the toner-pattern detecting unit.

2. The image forming apparatus according to claim 1, wherein the displacing unit includes a position adjusting inclined-member that abuts the rotation axis in the movement direction of the surface of the belt member at an inclined unit having an inclination angle with respect to the movement direction of the surface of the belt member in a movable manner, and the control unit moves the position adjusting inclined-member based on the result of detecting the toner pattern by the toner-pattern detecting unit, to adjust a position of the rotation axis in the movement direction of the surface of the belt member.

3. The image forming apparatus according to claim 1, wherein a driving-force supplying unit that supplies a driving force to the latent-image carriers through a driving gear and a driven gear that is provided on the rotation axis to which the driving force is supplied from the driving gear are arranged on end of the rotation axis in a longitudinal direction, and the displacing unit is arranged on the support unit on a side at which the driven gear is provided.

4. The image forming apparatus according to claim 3, wherein the position adjusting inclined-member is provided across the rotation axis opposite to a position at which the driving gear is provided in the movement direction of the surface of the belt member.

5. The image forming apparatus according to claim 1, wherein the displacing unit includes at least the position adjusting inclined-member, a rack gear provided to the position adjusting inclined-member, a pinion gear that engages with the rack gear, and a driving unit that drives the pinion gear, and the position adjusting inclined-member is configured to move by the driving force of the driving unit supplied through the pinion gear and the rack gear.

6. The image forming apparatus according to claim 1, wherein the support unit of one of the at least three latent-image carriers does not include the displacing unit.

7. The image forming apparatus according to claim 6, wherein four latent-image carriers are provided to form color images of four colors, and the support unit of one of the latent-image carriers for forming an image of one color out of the four colors does not include the displacing unit.

8. The image forming apparatus according to claim 7, wherein the one color out of the four colors is magenta.

9. The image forming apparatus according to claim 6, wherein a color image is formed with three colors of magenta, cyan, and yellow, and the support unit of one of the latent-image carriers for forming an image of one color out of the three colors does not include the displacing unit.

10. A method of adjusting a position of a latent-image carrier for an image forming apparatus that includes at least three latent-image carriers on each of which a latent image is formed, a support unit that supports a rotation axis of each of the latent-image carriers in a rotatable manner, a plurality of developing units for developing latent images formed on the latent-image carriers with toners of different colors, respectively, and a toner-pattern detecting unit that detects a toner pattern formed on a belt member that is suspended by a plurality of suspending members, the method comprising: adjusting the position of the latent-image carrier in a movement direction of the surface of the belt member by controlling a displacing unit that is provided to the support unit to displace the rotation axis along a surface of the belt member in the movement direction of the surface of the belt member based of a result of detecting the toner pattern by the toner-pattern detecting unit.

* * * * *